US008777782B2

(12) United States Patent
Salomon

(10) Patent No.: US 8,777,782 B2
(45) Date of Patent: Jul. 15, 2014

(54) FLAT BAT TRAINING METHOD AND APPARATUS

(76) Inventor: Khater M. Salomon, New Orleans, LA (US)

( * ) Notice: Subject to any disclaimer, the term of this patent is extended or adjusted under 35 U.S.C. 154(b) by 106 days.

(21) Appl. No.: 13/398,233

(22) Filed: Feb. 16, 2012

(65) Prior Publication Data

US 2012/0214623 A1 Aug. 23, 2012

Related U.S. Application Data

(60) Provisional application No. 61/443,278, filed on Feb. 16, 2011.

(51) Int. Cl.

| | |
|---|---|
| ***A63B 69/00*** | (2006.01) |
| ***A63B 59/00*** | (2006.01) |
| ***A63B 15/00*** | (2006.01) |
| ***A63B 69/38*** | (2006.01) |
| ***A63B 69/36*** | (2006.01) |

(52) U.S. Cl.

CPC ..... *A63B 59/0088* (2013.01); *A63B 15/00* (2013.01); *A63B 69/38* (2013.01); *A63B 69/36* (2013.01); *A63B 69/3623* (2013.01); *A63B 69/0002* (2013.01)

USPC ..... 473/457

(58) Field of Classification Search

USPC ..... 473/457, 519, 520, 564–568, 527–530

See application file for complete search history.

(56) References Cited

U.S. PATENT DOCUMENTS

| | | | | |
|---|---|---|---|---|
| D352,081 | S * | 11/1994 | Shelley | D21/729 |
| D397,385 | S * | 8/1998 | LaBorde et al. | D21/725 |
| 8,277,341 | B1 * | 10/2012 | Vignola | 473/457 |
| 2003/0069096 | A1 * | 4/2003 | Lin | 473/521 |
| 2009/0191986 | A1 * | 7/2009 | Bohm | 473/457 |
| 2009/0325736 | A1 * | 12/2009 | Carsello | 473/457 |
| 2010/0267499 | A1 * | 10/2010 | Magno | 473/457 |
| 2010/0311525 | A1 * | 12/2010 | Cornford et al. | 473/457 |
| 2011/0201461 | A1 * | 8/2011 | Gazzara et al. | 473/527 |
| 2011/0250994 | A1 * | 10/2011 | Budzielek | 473/457 |
| 2012/0010031 | A1 * | 1/2012 | Reisman et al. | 473/527 |
| 2012/0329585 | A1 * | 12/2012 | Windsor | 473/457 |
| 2013/0035179 | A1 * | 2/2013 | Vignola | 473/457 |

* cited by examiner

*Primary Examiner* — Mark Graham

(74) *Attorney, Agent, or Firm* — Ted M. Anthony

(57) ABSTRACT

A swing training method using a "flat bat" that breaks down swing motion into individual components. The flat bat has a handle connected to a flat member. The flat member has opposing flat surfaces that are beneficially color-coded to remind a user how to swing through a contact zone and follow through with a swing.

4 Claims, 5 Drawing Sheets

FLAT BAT TRAINING METHOD AND APPARATUS

CROSS REFERENCES TO RELATED APPLICATION

Priority of U.S. Provisional Patent Application Ser. No. 61/443,278, filed Feb. 16, 2011, incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for swing training. More particularly, the present invention pertains to a method for swing training using a "flat bat" apparatus. More particularly still, the present invention pertains to a method for swing training using a flat bat apparatus having opposing substantially flat surfaces colored blue and green.

2. Brief Description of the Prior Art

Many sports and other activities involve some form of swinging motion. Such sports include, without limitation, baseball, tennis, golf and cricket to name just a few. In each of these activities, which are too numerous to list, proper timing and form are frequently more instrumental than strength in achieving desired results. As a result, learning and practicing proper swing technique is typically of paramount importance. This is particularly true in the game of baseball where proper timing and technique—also known as having a properly "grooved" swing—is of paramount importance if a player is to achieve a high degree of consistency and performance.

Other swing training devices are known to exist. However, existing swing training devices typically mimic the shape, length, diameter, and circumference of standard equipment. For example, existing baseball swing training devices typically employ devices mimicking conventional baseball bats; the only variable between standard bats and these training devices being primarily in the weight of the training device. The method and apparatus of the present invention differs significantly, not only in the methodology of the training for which the device is designed, but also in the physical shape and coloration of the device.

SUMMARY OF THE PRESENT INVENTION

In the preferred embodiment, the apparatus of the present invention comprises a "flat bat" having a handle member and a substantially planar member attached to said handle member. Said substantially planar member has a first substantially flat surface, an opposing (second) substantially flat surface, and an edge surface defined between said first and second faces. Although any number of other colors can be utilized, the substantially planar member of said training apparatus can be beneficially colored green, blue and red; that is, one substantially flat surface can be colored green, the opposing substantially flat surface can be colored blue, and the edge surface of said substantially planar member (disposed between said substantially flat surfaces) can be colored red.

The dimensions of the present invention can vary depending on a variety of different factors and variables. However, in a preferred embodiment, the flat bat apparatus of the present invention can beneficially have the following illustrative dimensions: said substantially planar member can measure approximately 20" to 22" in length, being approximately 7" in width at its widest point; said handle member can measure approximately 8" to 10" in length for a total length of the device ranging from approximately 28" to 30".

In said preferred embodiment, one substantially flat surface of said substantially planar member of the apparatus is colored green, while the opposite side of said substantially planar section is colored blue. Further, although the apparatus can be constructed from any number of materials, it can be constructed of wood. Holes can extend through said substantially planar section for reduced weight and increased aerodynamic efficiency and swing speed.

Said handle of the apparatus has a substantially cylindrical shape, although said handle can be shaped to conform to a user's hands and/or improve grip strength characteristics. Further, said handle member can be wrapped in covering (similar to the handle of a tennis racquet) for maximum grip stability and hand comfort. Said handle member is connected at one end to said substantially planar member. In the preferred embodiment, at the opposite end of the handle member is knob having a larger diameter than said handle member.

The objective of the method and apparatus of the present invention is not to mimic the design of the standard baseball bat but rather to break down the motion of the swing into its individual components, from the forward motion, through the turning of the hands in the proper direction to the follow-through in a smooth, arc-like motion. In this way the device acts as a training tool, orienting the user to the proper sense of direction the hands must follow in the application of the actual swinging of a baseball bat in competitive play, while at the same time conditioning the individual's mind to become aware of the full range of motion of the swing, including the turning of the arms and wrists in sequential harmony. With that sense of awareness the objective becomes a properly executed swing each time an individual swings an actual baseball bat.

Other embodiments are disclosed, and each of the embodiments can be used alone or together in combination. Additional features and advantages of the disclosed embodiments are described in, and will be apparent from, the following Detailed Description and the drawings.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
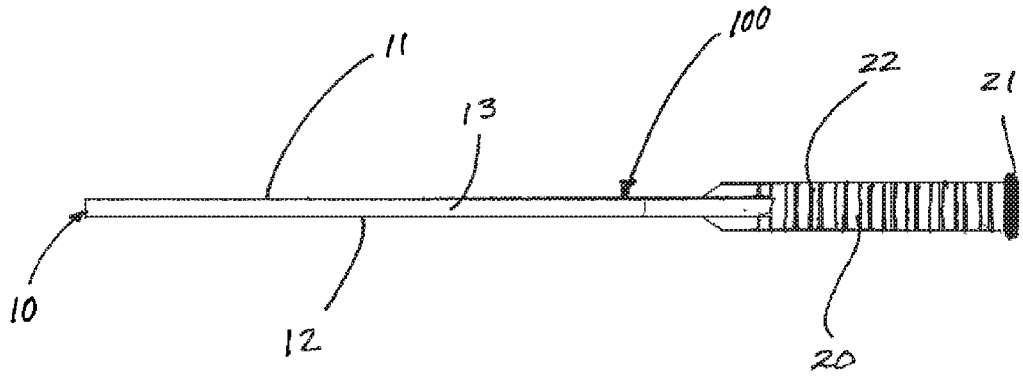
FIG. 1 depicts a side view of the swing training apparatus of the present invention.

Referring to the drawings, FIG. 1 depicts a side view of a preferred embodiment of swing training apparatus 100 of the present invention. Said swing training apparatus 100 comprises a "flat bat" having handle member 20 and substantially planar member 10 attached to said handle member 20. Substantially planar member 10 has a first substantially flat surface 11, an opposing (second) substantially flat surface 12, and an edge surface 13 formed between said first and second substantially flat surfaces 11 and 12.

Still referring to FIG. 1, said handle member 20 has a substantially cylindrical shape, although said handle member 20 can also be modified, if desired, to conform to a user's hands and/or improve grip strength characteristics. For example, said handle member 20 can include indentations on its outer surface for receiving fingers used to grip said handle member 20.

Further, said handle member 20 can be wrapped in covering 22 (similar to the handle of a tennis racquet) for maximum grip stability and hand comfort. Said covering 22 can be absorbent for absorbing sweat or other moisture, and can provide improved frictional characteristics for increased grip strength. Handle member 20 is connected at one end to said substantially planar member 10, while oversized end knob 21 having a larger diameter than said handle member 20 is disposed at the distal end of said handle member 20.

The dimensions of the present invention can vary depending on a variety of different factors and variables. However, in a preferred embodiment, the flat bat swing training apparatus 100 of the present invention can beneficially have the following illustrative dimensions: said substantially planar member 10 can measure approximately 20" to 22" in length, being approximately 7" in width at its widest point; said handle member 20 can measure approximately 8" to 10" in length for a total length of swing training apparatus 100 ranging from approximately 28" to 30".

Figure 2:
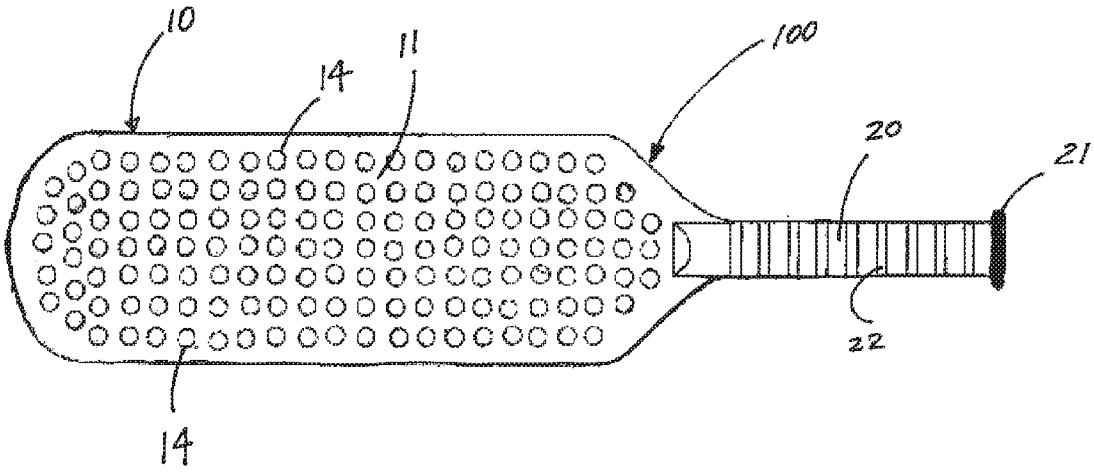
FIG. 2 depicts a front view of the swing training apparatus of the present invention.

FIG. 2 depicts a front view of swing training apparatus 100 of the present invention. In the view depicted in FIG. 2, said swing training apparatus 100 is turned (that is, phased) ninety degrees from the view depicted in FIG. 1. Swing training apparatus 100 comprises a "flat bat" having handle member 20 and substantially planar member 10 attached to said handle member 20. Said handle member 20 has a substantially cylindrical shape, although said handle member 20 can be shaped to conform to a user's hands and/or improve grip strength characteristics.

As noted above, handle member 20 can be wrapped in covering 22 (similar to the handle of a tennis racquet) for maximum grip stability and hand comfort. Said covering 22 can be absorbent for soaking sweat or other moisture, and can provide improved frictional characteristics for increased grip strength. Oversized end knob 21 is disposed at the distal end of said handle member 20.

In the view depicted in FIG. 2, swing training apparatus 100 has substantially planar member 10 having substantially flat surface 11. Although not visible in FIG. 2, substantially planar member 10 also has opposing substantially flat surface 12 that is obscured from view in FIG. 2. In the preferred embodiment, a plurality of holes 14 are disposed through said substantially planar member 10 (and, accordingly, substantially flat surfaces 11 and 12). Said holes reduce the material of said substantially planar member 10, thereby reducing the weight of swing training apparatus 100; such reduced weight, together with increased aerodynamic efficiency, permit increased swing speed for swing training apparatus 100.

Figure 3:
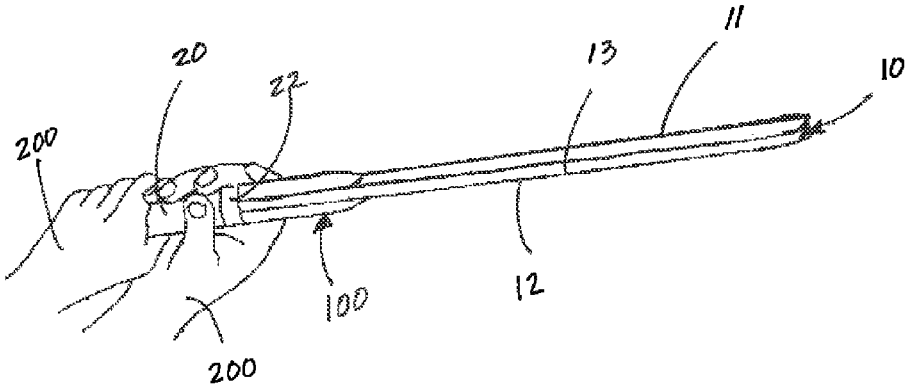
FIG. 3 depicts a side view of a user gripping the swing training apparatus of the present invention.

FIG. 3 is a side view of a user's hands 200 gripping swing training apparatus 100 of the present invention. As noted above, said swing training apparatus 100 comprises a "flat bat" having handle member 20 and substantially planar member 10 attached to said handle member 20. Substantially planar member 10 has a first substantially flat surface 11, an opposing (second) substantially flat surface 12, and an edge surface 13 formed between said first and second substantially flat surfaces 11 and 12. As depicted in FIG. 3, hands 200 of a user are depicted gripping substantially cylindrical handle member 20 much like a grip used for a conventional baseball bat.

Figure 4:
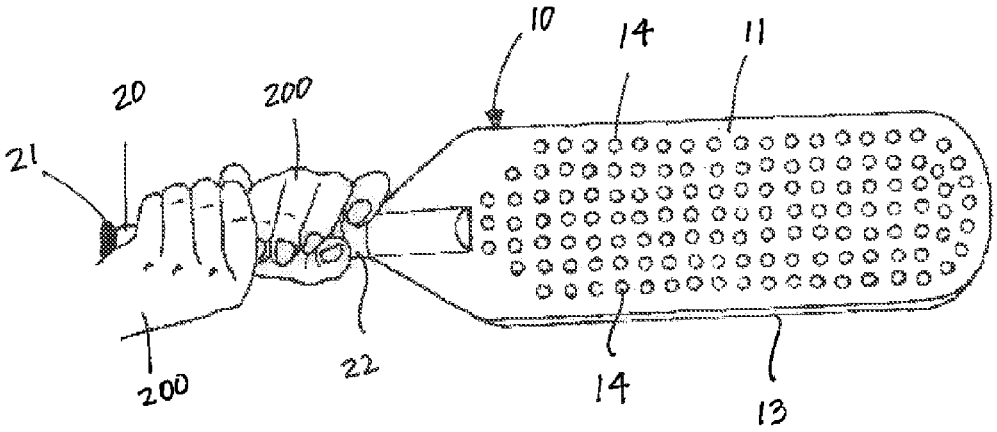
FIG. 4 depicts a front view of a user gripping the swing training apparatus of the present invention.

FIG. 4 depicts a front view of a user's hands 200 gripping swing training apparatus 100 of the present invention. In the view depicted in FIG. 4, said swing training apparatus 100 is turned (that is, phased) ninety degrees from the view depicted in FIG. 3. Swing training apparatus 100 comprises a "flat bat" having handle member 20 and substantially planar member 10 attached to said handle member 20 and end knob 21. Said handle member 20 has a substantially cylindrical shape, although said handle member 20 can be shaped to conform to a user's hands and/or improve grip strength characteristics. As depicted in FIG. 4, hands 200 of a user are depicted gripping substantially cylindrical handle member 20 much like a grip used for a conventional baseball bat.

Still referring to FIG. 4, swing training apparatus 100 has substantially planar member 10 having substantially flat surface 11. Although not visible in FIG. 4, substantially planar member 10 also has opposing substantially flat surface 12 that is obscured from view in FIG. 4. In the preferred embodiment, a plurality of holes 14 are disposed through said substantially planar member 10 (and, accordingly, substantially flat surfaces 11 and 12).

Although any number of other colors and/or color combinations can be utilized, substantially planar member 10 of said swing training apparatus 100 can be beneficially colored green, blue and red. Specifically, referring back to FIG. 3, substantially flat surface 11 can be colored green, opposing substantially flat surface 12 can be colored blue, and edge surface 13 of said substantially planar member 10 (disposed between said substantially flat surfaces) can be colored red.

Figure 5:
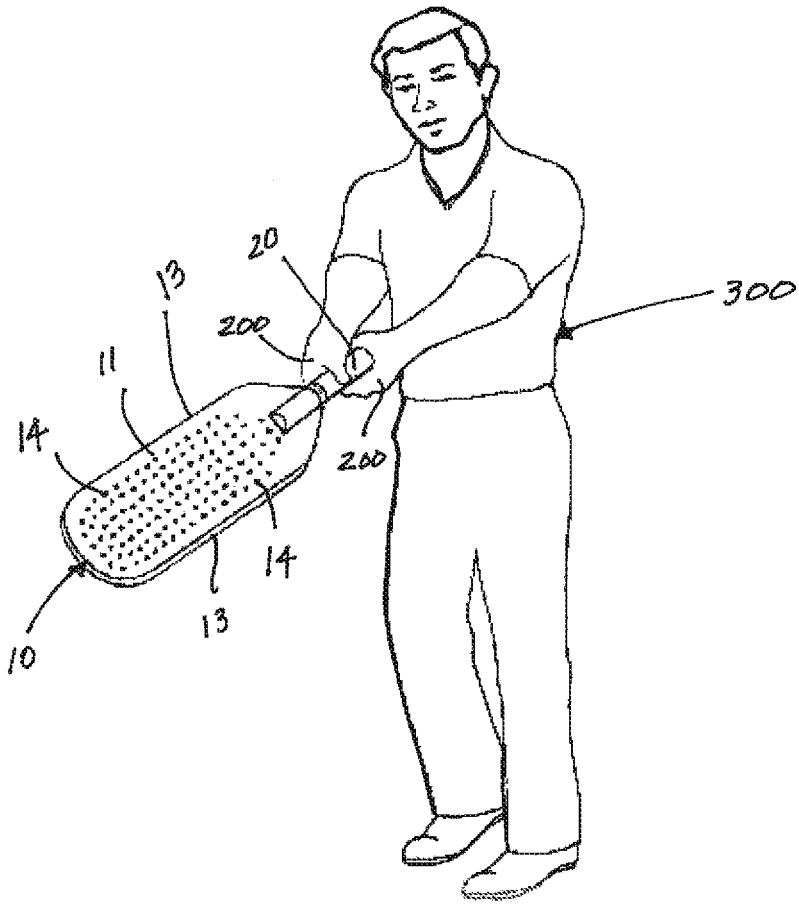
FIG. 5 depicts a perspective view of a user utilizing the swing training apparatus of the present invention at an early stage of a swing.

FIG. 5 depicts a perspective view of a user 300 swinging swing training apparatus 100 of the present invention at an early stage of a conventional baseball hitting (swing) motion. Hands 200 of user 300 are depicted gripping handle member 20 of swing training apparatus 100 of the present invention. As depicted in FIG. 5, hands 200 are using essentially the same grip as used for swinging conventional baseball bats.

In the view depicted in FIG. 5, substantially planar member 10 has a first substantially flat surface 11 facing substantially upward, an opposing (second) substantially flat surface 12 (obscured from view in FIG. 5) facing substantially downward, edge surface 13 formed between said first and second substantially flat surfaces 11 and 12, and a plurality of holes 14 disposed through said substantially planar member 10.

Figure 6:
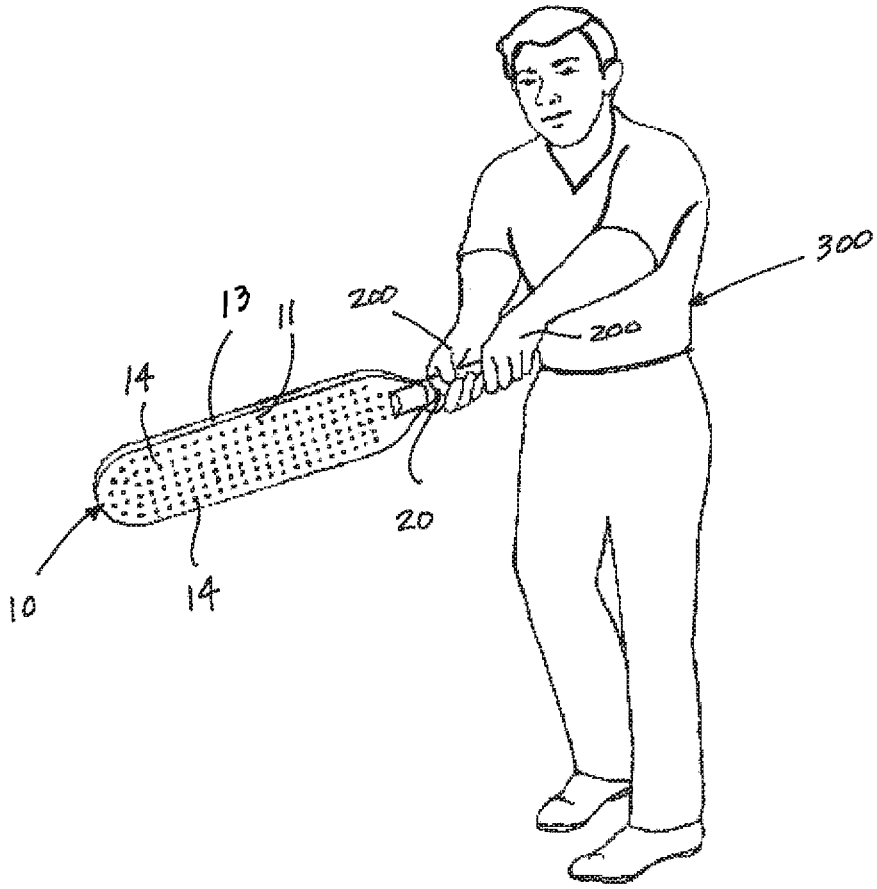
FIG. 6 depicts a perspective view of a user utilizing the swing training apparatus of the present invention at a subsequent stage of a swing.

FIG. 6 depicts a perspective view of a user 300 swinging swing training apparatus 100 of the present invention at a subsequent stage of a conventional baseball hitting (swing) motion than that depicted in FIG. 5. In other words, the stage of the swing depicted in FIG. 6 occurs in sequence slightly after the swing stage depicted in FIG. 5. Hands 200 of user 300 are depicted gripping handle member 20 of swing training apparatus 100 of the present invention. As depicted in FIG. 6, hands 200 are using essentially the same grip as depicted in FIG. 5.

In the view depicted in FIG. 6, first substantially flat surface 11 is facing substantially forward relative to user 300; that is, said substantially flat surface 11 is oriented substantially vertical, or perpendicular to the ground. Although obscured from view in FIG. 6, opposing surface 12 is also oriented substantially vertically, or perpendicular to the ground. As depicted in FIG. 6, edge surface 13 formed between said first and second substantially flat surfaces 11 and 12, faces upward along one long edge of planar member 10, and downward along the opposite long edge of planar member 10. FIG. 6 generally represents a hitting zone, wherein a batter would expect a bat to make contact with a pitched baseball.

Figure 7:
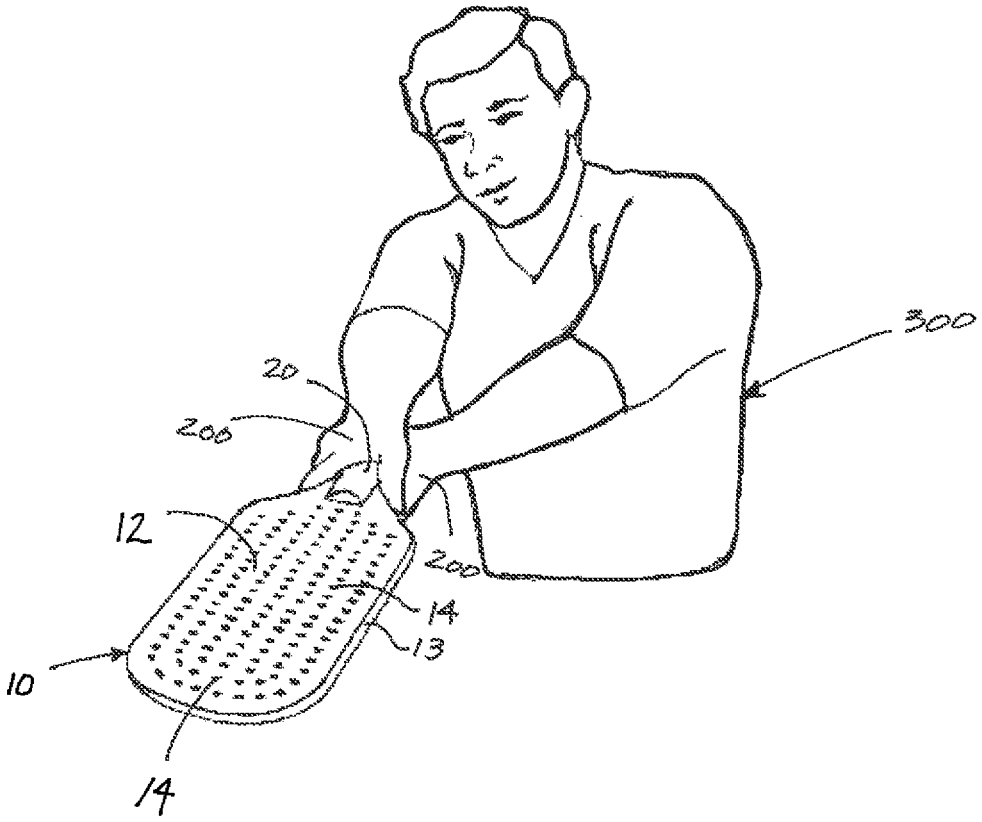
FIG. 7 depicts a perspective view of a user utilizing the swing training apparatus of the present invention at a final stage of a swing.

FIG. 7 depicts a perspective view of a user 300 swinging swing training apparatus 100 of the present invention at a substantially final or finishing stage of a conventional baseball hitting (swing) motion. In other words, the stage of the swing depicted in FIG. 7 occurs sequentially slightly after the swing stage depicted in FIG. 6. Hands 200 of user 300 are depicted gripping handle member 20 of swing training apparatus 100 of the present invention. As depicted in FIG. 7, hands 200 are using essentially the same grip as depicted in FIGS. 5 and 6.

In the view depicted in FIG. 7, first substantially flat surface 11 is facing substantially downward relative to user 300; that is, said substantially flat surface 11 is oriented substantially horizontal, or parallel to and facing the ground. Opposing substantially flat surface 12 is also oriented substantially horizontal, or parallel to the ground; however, surface 12 is facing upward, away from the ground and toward the sky.

An objective of the method the present invention is to break down swing motion into individual components, from the forward motion (FIG. 5), through the turning of the hands in the proper direction in order to make contact (FIG. 6), to the follow-through in a smooth, arc-like motion (FIG. 7). In this manner, swing training apparatus 100 serves as a training tool, orienting a user (such as user 300 in FIGS. 5-7) to a proper sense of direction that hands 200 must follow during the swinging of a baseball bat in competitive play, while at the same time conditioning the user's mind to become aware of the full range of motion of the swing, including the turning of the arms and wrists in sequential harmony. With that sense of awareness, a user can create "muscle memory", beneficially training a properly executed swing each time a user swings an actual baseball bat.

As noted above, although any number of other colors and/or color combinations can be utilized, substantially planar member 10 of said swing training apparatus 100 can be beneficially colored green, blue and red. In such a configuration, substantially flat surface 11 can be colored green, opposing substantially flat surface 12 can be colored blue, and edge surface 13 of said substantially planar member 10 (disposed between said substantially flat surfaces) can be colored red.

Referring to the swing sequence depicted in FIGS. 5 through 7, a swing can begin with green substantially flat surface 11 facing substantially upward as depicted in FIG. 5. As the swing motion progresses to the contact zone or striking position depicted in FIG. 6, said substantially planar member 10 is oriented generally vertically, with green substantially flat surface 11 facing forward and blue substantially flat surface 12 facing backward, and red edge 13 facing upward (and in clear view of user 300). As the swing motion progresses further to the follow through position depicted in FIG. 7, said substantially planar member 10 is oriented generally horizontally, with green (suggestive of the color of grass) substantially flat surface 11 facing downward toward the ground, and blue (suggestive of the color of the sky) substantially flat surface 12 facing upward toward the sky. Said colors can have the effect of reminding a user 300 of desired positions for swing training apparatus 100 including, without limitation, red edge 13 facing upward in the "contact zone", as well as green surface 11 facing downward toward the "grass" and blue surface 12 facing upward toward the sky, at or near the end of the swing motion.

The method and apparatus of the present invention are described herein primarily in the context of swing training for the sport of baseball and the swinging of a baseball bat. However, it is to be observed that the method and apparatus of the present invention described herein can also be utilized in connection with training for other sports involving the use of swings or similar motions including, without limitation, tennis, golf, cricket and many other activities.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A training method for improving a trainee's swing for hitting an object comprising:

a) gripping a swing training apparatus comprising:

(i) a handle member; and (ii) a substantially planar member affixed to said handle member having opposing first and second substantially flat surfaces and an edge between said first and second surfaces, wherein said first substantially flat surface has a first color representing a downward direction, said second substantially flat surface has a different second color representing an upward direction, and said edge has a different third color representing an impact zone for hitting said object; and b) swinging said swing training apparatus using a swing having at least three positions comprising:

(i) a first position wherein said first and second substantially flat surfaces are oriented substantially horizontally, said first substantially flat surface is facing upward, and said second substantially flat surface is facing downward;

(ii) a second position corresponding to an impact zone wherein said first and second substantially flat surfaces are oriented substantially vertically, and said edge is oriented substantially upward and is visible to a trainee;

(iii) a third position wherein said first and second substantially flat surfaces are oriented substantially horizontally, said first substantially flat surface is facing downward, and said second substantially flat surface is facing upward; and c) repeating said swing to train muscle memory of said swing positions.

2. The method of claim 1, wherein said first color is green.

3. The method of claim 1, wherein said second color is blue.

4. The method of claim 1, wherein said third color is red.

* * * * *